US007862225B2

(12) United States Patent
Betchan et al.

(10) Patent No.: US 7,862,225 B2
(45) Date of Patent: Jan. 4, 2011

(54) APPARATUS AND METHOD FOR MIXING A CLEANING SOLUTION FOR A VEHICLE WASHING SYSTEM

(75) Inventors: Thomas C. Betchan, Rockdale, TX (US); Daniel R. Kramer, Huntington Woods, MI (US)

(73) Assignee: Stone Soap Company, Inc., Sylan Lake, MI (US)

( * ) Notice: Subject to any disclaimer, the term of this patent is extended or adjusted under 35 U.S.C. 154(b) by 137 days.

(21) Appl. No.: 11/492,550

(22) Filed: Jul. 25, 2006

(65) Prior Publication Data

US 2008/0025142 A1 Jan. 31, 2008

(51) Int. Cl.
*B01F 5/04* (2006.01)

(52) U.S. Cl. ..... 366/153.1; 366/173.2

(58) Field of Classification Search ..... 366/151.1, 366/153.1, 160.1, 162.1, 182.4, 167.1, 173.1, 366/173.2, 160.2, 152.2; 73/427; 222/158; 215/365; 220/568, 662; 137/268
See application file for complete search history.

(56) References Cited

U.S. PATENT DOCUMENTS

| | | | | | |
|---|---|---|---|---|---|
| 926,144 | A | * | 6/1909 | Sherow | 366/165.2 |
| 1,136,705 | A | * | 4/1915 | Nichols | 366/165.5 |
| 1,580,476 | A | * | 4/1926 | Fassio | 68/184 |
| 1,878,825 | A | * | 9/1932 | Caise | 68/184 |
| 2,900,176 | A | * | 8/1959 | Krogel | 366/137 |
| 2,906,607 | A | * | 9/1959 | Jamison | 422/278 |
| 3,578,001 | A | * | 5/1971 | Attaway | 134/45 |
| 3,807,701 | A | * | 4/1974 | Reid et al. | 366/132 |
| 3,885,587 | A | * | 5/1975 | Troope | 137/391 |
| 3,948,490 | A | * | 4/1976 | Troope | 366/144 |
| 4,006,888 | A | * | 2/1977 | Emmons | 366/153.1 |
| 4,010,934 | A | * | 3/1977 | McCord et al. | 366/142 |
| 4,098,494 | A | * | 7/1978 | Howlett | 366/144 |
| 4,099,267 | A | * | 7/1978 | King | 366/142 |
| 4,187,029 | A | * | 2/1980 | Canale et al. | 366/153.1 |
| 4,362,033 | A | * | 12/1982 | Young | 68/207 |
| 4,474,476 | A | * | 10/1984 | Thomsen | 366/152.4 |
| 4,669,888 | A | * | 6/1987 | Yamaguchi et al. | 366/160.2 |
| 4,669,889 | A | * | 6/1987 | Yamaguchi et al. | 366/160.2 |
| 4,718,447 | A | | 1/1988 | Marshall | |
| 4,812,045 | A | * | 3/1989 | Rivers | 366/107 |
| 4,820,053 | A | * | 4/1989 | Rivers | 366/137 |
| 4,955,723 | A | * | 9/1990 | Schneider | 366/136 |

(Continued)

FOREIGN PATENT DOCUMENTS

GB 2114906 A * 9/1983

*Primary Examiner*—Charles Cooley
(74) *Attorney, Agent, or Firm*—Brooks Kushman P.C.

(57) ABSTRACT

An apparatus configured for mixing and distributing a cleaning solution for use in a vehicle washing system. A container includes a cavity configured to receive the cleaning solution. A supply device for providing an aqueous solution includes a control mechanism for determining the level of aqueous solution in the container. One or more conduits in fluid communication with the supply device supply the aqueous solution to the container. A distribution device in communication with the cavity of the container is configured to remove the aqueous solution from the container for distribution to the vehicle washing system. The one or more conduits include one or more injection inlets for supplying the aqueous solution under pressure to dilute an additive placed in the container with the aqueous solution to create the cleaning solution.

17 Claims, 3 Drawing Sheets

U.S. PATENT DOCUMENTS 5,072,884 A * 12/1991 Ellison et al. ..... 220/674
5,211,475 A * 5/1993 McDermott ..... 366/137
5,253,937 A * 10/1993 Scheimann et al. ..... 366/136
5,369,032 A * 11/1994 Pratt ..... 435/286.7
5,374,119 A * 12/1994 Scheimann ..... 366/101
5,439,020 A * 8/1995 Lockhart ..... 137/3
5,544,951 A 8/1996 Alack
5,580,168 A * 12/1996 Alireza et al. ..... 366/153.1
5,655,713 A * 8/1997 Gibney et al. ..... 239/310
5,678,593 A * 10/1997 Lockhart ..... 137/268
5,769,536 A * 6/1998 Kotylak ..... 366/136
5,951,161 A * 9/1999 Blagg ..... 366/152.6
5,961,845 A * 10/1999 List et al. ..... 210/767
6,413,416 B1 * 7/2002 Buchan ..... 210/97
6,481,884 B1 * 11/2002 Wetherington ..... 366/136
6,645,924 B2 11/2003 Klos et al.
6,739,747 B2 * 5/2004 Millward ..... 366/167.1
7,140,405 B2 * 11/2006 Lewis et al. ..... 366/160.2
7,300,197 B2 * 11/2007 McCurdy et al. ..... 366/153.1
2003/0062387 A1 * 4/2003 Diamanti et al. ..... 73/427
2003/0193833 A1 * 10/2003 Wulf et al. ..... 366/142
2004/0101455 A1 5/2004 Klos et al.
2004/0264295 A1 12/2004 Lewis et al.
2005/0099883 A1 * 5/2005 Choi ..... 366/152.2
2005/0185505 A1 8/2005 McCurdy et al.
2008/0025142 A1 * 1/2008 Betchan et al. ..... 366/173.2

* cited by examiner

APPARATUS AND METHOD FOR MIXING A CLEANING SOLUTION FOR A VEHICLE WASHING SYSTEM

BACKGROUND OF THE INVENTION

1. Field of the Invention

The present invention relates generally to a vehicle washing system and, more particularly, to an apparatus for mixing and distributing detergent solutions for use in a vehicle washing system.

2. Background Art

Vehicle washing systems typically use a variety of cleaning solutions during the wash process to remove particles from the exterior surface of the vehicle. Operators of these vehicle washing systems typically face choices with respect to the type of detergents to be used. For example, most car wash system operators use detergents in a concentrated liquid form or a powder detergent form.

Use of powder detergents rather than premixed liquid detergents reduces the possibility of breakdown in the chemical properties required to cleanse a vehicle when stored in an undiluted form prior to mixing with a liquid mixing solution, typically water. Further, powder detergents are easier to ship and store, especially valuable when the car wash operators own touchless or automatic car washing systems that generally do not include full time staff.

One limitation associated with the use of powder detergents is that the detergents must be mixed to an appropriate equilibrium with an aqueous or mixing solution to ensure proper dilution of the powder detergent in the mixing solution. For purposes of explanation, equilibrium in a cleaning solution occurs when the powder detergent is dissolved in the aqueous solution, such as water, such that the detergent will reach its maximum saturation point at which additional added detergent will not dissolve and will fall to the bottom of the container. Obtaining this equilibrium without the assistance of a mixing apparatus can be difficult to achieve without certain guidelines.

It is also possible that if the aqueous solution is not introduced to the powder detergent for extended periods of time, for example, long periods of inactivity in the car wash as a result of lack of use due to inclement weather conditions, it is likely that the powder detergent, as a result of not being mixed properly, may harden into unusable segments of powder material. This is also problematic in that once hardened, the powder detergent must be removed with extensive manual labor to free the material from a mixing drum which could result in further inactivity of the car wash while this problem is addressed.

It would be advantageous to provide a vehicle washing system having a mixing apparatus that would properly mix an additive with an aqueous solution to provide a washing solution at a proper chemical equilibrium. It is also desirable to provide a mixing apparatus which allows for the mixing of an additive with an aqueous solution without the need for active mixing ordinarily provided by electrically or air powder stirring devices. Further, it would be advantageous to provide a vehicle washing system with a mixing apparatus that would introduce the aqueous solution to top and bottom portions of the additive to prevent caking of the additive and maintain the equilibrium of the washing solution.

SUMMARY OF THE INVENTION

The present invention provides an apparatus configured for mixing and distributing a cleaning solution for use in a vehicle washing system. A container includes a cavity configured to receive the cleaning solution. A supply device for providing an aqueous solution includes a control mechanism for determining the level of aqueous solution in the container.

One or more conduits in fluid communication with the supply device supply the aqueous solution to the container. A distribution device in communication with the cavity of the container is configured to remove the aqueous solution from the container for distribution to the vehicle washing system. The one or more conduits include one or more injection inlets for supplying the aqueous solution under pressure to dilute an additive placed in the container with the aqueous solution to create the cleaning solution.

Other features and advantages of the present invention will be readily appreciated and better understood after reading the subsequent description when considered in connection with the accompanying drawings.

DETAILED DESCRIPTION OF THE PREFERRED EMBODIMENT(S)

Figure 1:
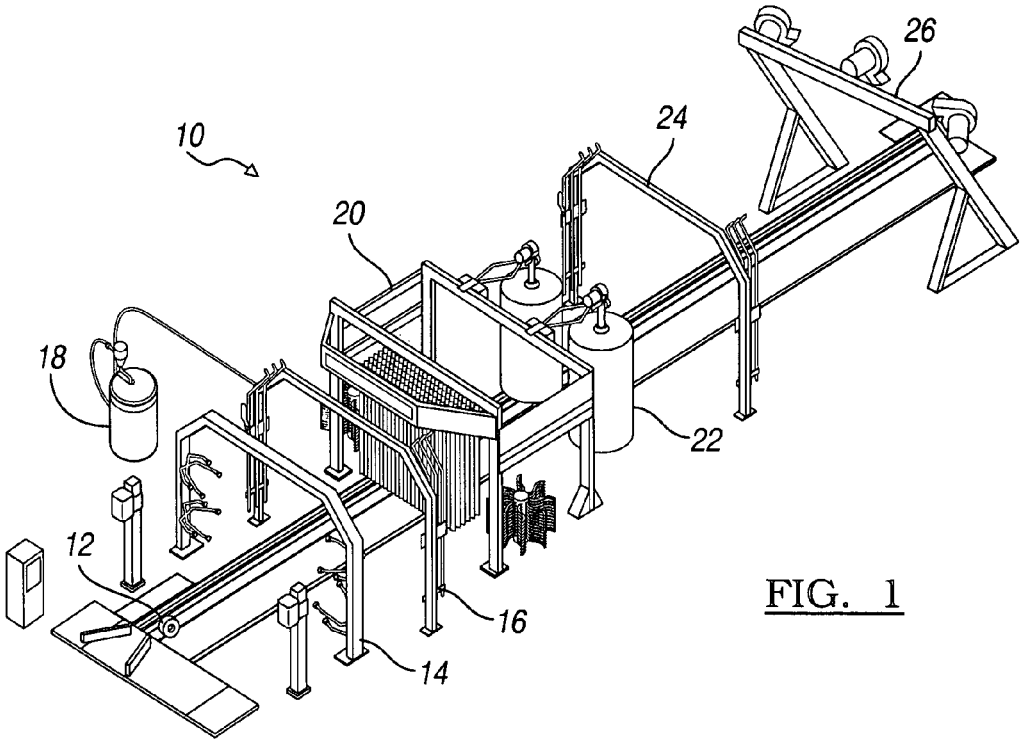
FIG. 1 is a perspective view of a vehicle washing system for use in connection with the present invention.

Referring now to the Figures, a vehicle washing system in accordance with the present invention is disclosed. A mixing apparatus is coupled to a washing system for supplying a washing solution. It is understood that the mixing apparatus may be used in any type of vehicle washing system.

In the following description, various operating parameters and components are described for a number of constructed embodiments. These specific parameters and components are included as examples and are not meant to be limiting. More specifically, directional language such as "left", "right", "above", "below", "upper", "lower" and words of similar import designate directions shown in the drawings. Such directional terminology is used for clarity and is not intended to strictly limit the orientation of any aspect of the invention to a particular plane or direction.

Referring now to the Figures, a vehicle washing system and a mixing apparatus configured for mixing and feeding a cleaning solution to the vehicle washing system is disclosed and illustrated. Referring now to FIG. 1, an exemplary vehicle washing system 10 for use with the present invention is illustrated. It is understood that washing system 10 may include a variety of components. These components are discussed herein for exemplary purposes only.

Vehicle washing system 10 is configured to allow a vehicle (not shown) to pass through one or more components for removing debris from the exterior of the vehicle. Washing system 10 may include one or more of the following components described herein. Washing system 10 may include a rail 12 for guiding the vehicle through the washing system 10.

Rail 12 may include a drive mechanism for moving the vehicle through the washing system.

A plurality of nozzles may be provided on frame 14 to apply a aqueous solution to the vehicle. It is contemplated that nozzles will apply water under pressure to the exterior surface of the vehicle. Frame 16 includes one or more application mechanisms for applying a detergent washing solution from a supply apparatus 18 to the vehicle. Supply apparatus 18 may be a distinct container or alternatively, as described below, a detergent mixing apparatus positioned at a site, such as an automated car wash, where a detergent solution of predetermined concentration is required.

It is understood that the detergent washing solution and water may be applied in distinct steps by separate nozzles, or, alternatively, simultaneously by the same plurality of nozzles. It is also understood that any variety of the applications described above can be used to accomplish the same objective.

Frame 20 includes one or more brushes 22 for engaging the exterior of the vehicle to apply the washing solution to clean the various sides of the vehicle. An additional cleaning solution or aqueous solution may be applied by a plurality of nozzles on frame 24. As the vehicle exits the washing system 10, one or more blowers mounted on frame 26 forces air onto the exterior of the vehicle to remove water from the vehicle. It is contemplated that the washing system may include one or more components that move about a vehicle rather than a vehicle moving through the components.

Figure 2:
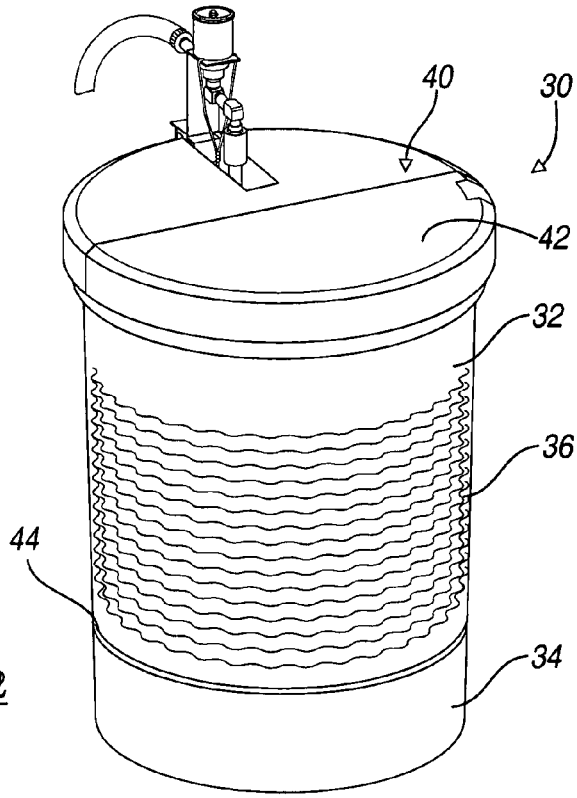
FIG. 2 is a perspective view of a mixing apparatus for use with a vehicle washing system in accordance with the present invention.

Referring now to FIG. 2, a detergent mixing apparatus 30 generally includes a drum or container 32 having a cavity configured to receive an additive 34 that, when combined with an aqueous mixing solution such as water, forms a washing solution 36. Apparatus 30 is configured to liquefy or dissolve the additive, such as a solid soluble material or powder detergent placed in the container 32. It is contemplated that the additive may be added from a package to a container. It is also contemplated that the additive may be shipped in the container for use in the vehicle washing system.

Additive 34 may be provided as a dry granular material. However, it is understood that the additive may comprise a solid, powder, liquid or paste form. It is also contemplated that the additive may be a dry granular detergent or other solid that can be dissolved in an aqueous solution. The additive may be a liquid detergent that could constitute solvents, surfactants, dyes, foamers, wetting agents and couplers. Additives may be used for a variety of applications, including presoaking, washing, engine degreasing and tire cleaning during the washing process.

Referring additionally to FIG. 2, container 32 may be of various sizes and shapes depending on the requirements of the washing system or product manufacturer. For purposes of explanation, container 32 is generally cylindrical and includes an opening 38 in an upper surface of the container. Container may be fabricated from any material suitable for storing or transporting solid and/or liquid chemical compositions. Molded polyethylene is generally acceptable for use in this area based on its impact and corrosion resistance properties, as well as a degree of translucence that allows an individual to determine the levels of materials in the container 32.

In one aspect of the present invention, container 32 includes a lid 40 that at least partially covers the opening in container 32 to cover the additive 34 and the cleaning solution byproduct 36 to prevent contaminants from entering therein and any damage to the mixing equipment described below. Lid may be formed as part of the container, or removably secured to the container 32.

Lid 40 may include a hinged portion 42 that allows a user to access container without removing lid 40 from the container 32. It is understood that the mixing apparatus does not require use of a lid to function in accordance with the present invention. Container may include one or more indicators 44 formed thereon to assist a user to fill the container 32 to an appropriate level. The lid 40 of container is either removed or the hinged portion 42 is pivoted to an open position to allow addition of the additive 34 to be placed in the container 32.

Referring now to FIGS. 3-6, mixing apparatus 30 includes a turbulation or additive dissolution system which assists in the mixing process. System includes a supply device 46 configured for connection to a supply line 48, such as a hose or the like. Supply line 48 may be configured for connection to a standard municipal water supply line to provide an aqueous solution, such as water, for use in the mixing process. In one aspect of the present invention, the aqueous solution is water from a municipal water source. In another aspect of the present invention, the aqueous solution is water or another mixing solution delivered through the supply line water under a pressure of generally between 30 PSI and 60 PSI.

Device 46 cooperates with supply conduit 48 to supply an aqueous solution to conduits 50 connected thereto. Supply device 46 is removably secured to container 32 by mount 52. Device 46 cooperates with a float 54 disposed within container 32 to adjust the level of solution in container 32. Float 54 is buoyant in relation to the washing solution 36 stored in the container 32 and is adjustably positioned inside container 32 with adjustment in the level of washing solution 36 disposed therein. Float 54 may be made of any suitable lightweight material, such as a hollowed polymeric structure, styrofoam wood or other material that may include material inside to provide sufficient displacement to support the float and its associated components in the solution.

It is understood that supply device 46 may be configured from individual components or purchased as a commercial unit, such as a Hydro Systems, Inc. Hydrominder Model 506. Supply device 46 is operable to keep container 32 filled to a sufficient level with an aqueous solution to support the mixing process. For example, supply device 46 may include a magnetically actuated valve that is selectively opened when the float 54 supported by the cleaning solution drops below a certain level to add additional aqueous solution to the container. The valve terminates the flow of aqueous solution when the liquid level in the container reaches a predetermined height.

In one aspect of operation, the valve of the supply device 46 is selectively activated by the motion of the cooperating float 54 in the container 32. As the float 54 rises with the level of the solution in container, the valve of supply device 46 will close at a point when the weight of the float 54, transmitted through a chain 56, releases spring tension in the valve. Likewise, lowering of the liquid level causes the float 54 to exert a downward tension through the chain 56 and open the valve of supply device 46 to permit the aqueous solution from the supply line 48 to flow through conduits 50 into container 32. The supply of cleaning solution will be automatically made anytime the level in the container 32 falls below a predetermined level. Additional description of the mixing process will be provided in greater detail below.

Figure 3:
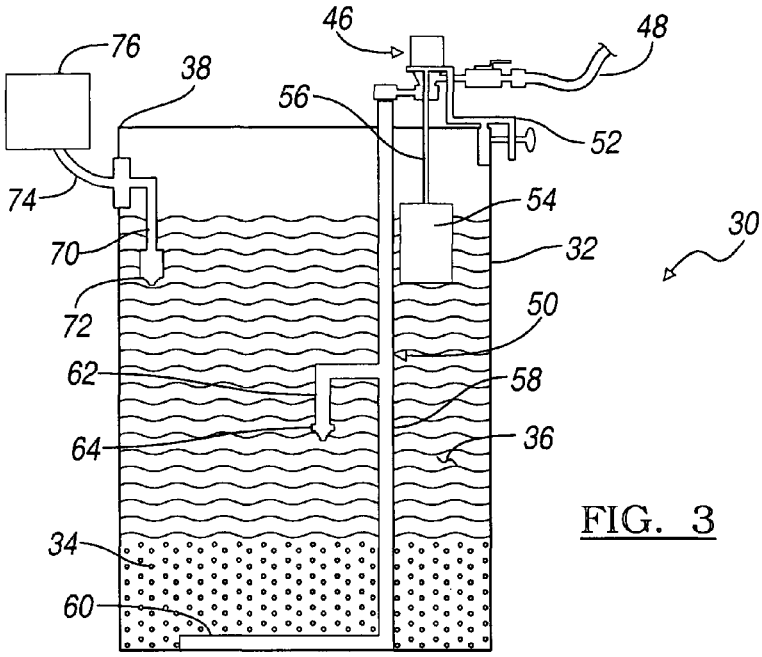
FIG. 3 is a side plan view of the mixing apparatus.
Figure 4:
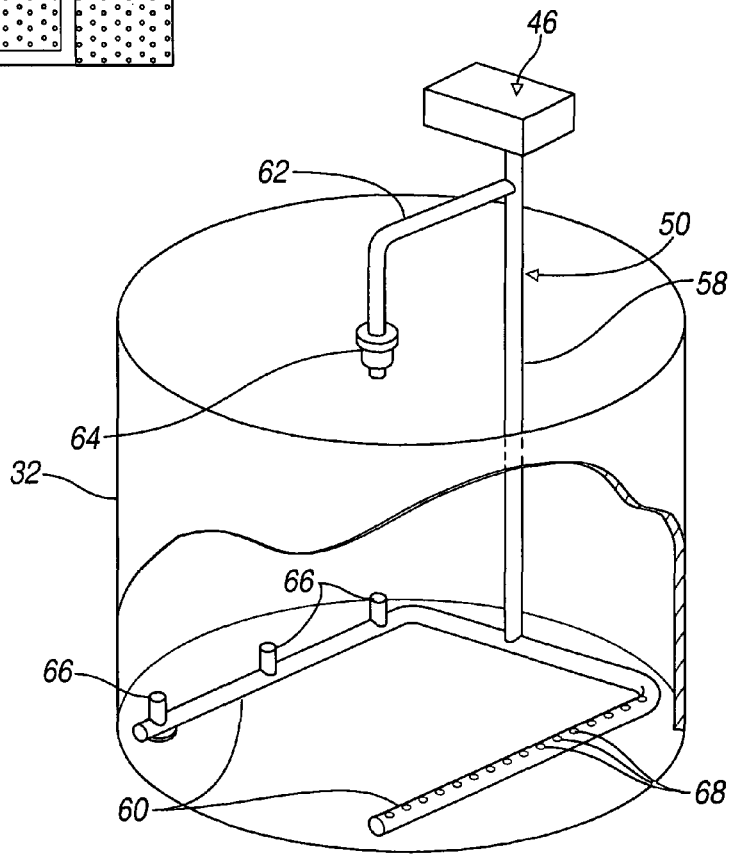
FIG. 4 is a perspective view of a turbulation system for use with the mixing apparatus in accordance with the present invention.
Figure 5:
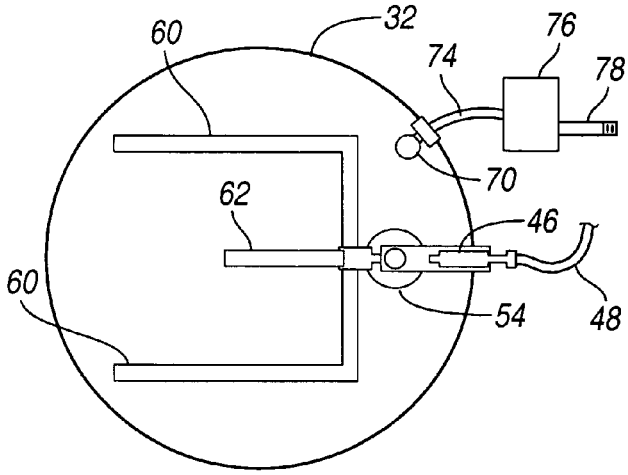
FIG. 5 is a top plan view of the turbulation system and detergent feed valve in the mixing apparatus.
Figure 6:
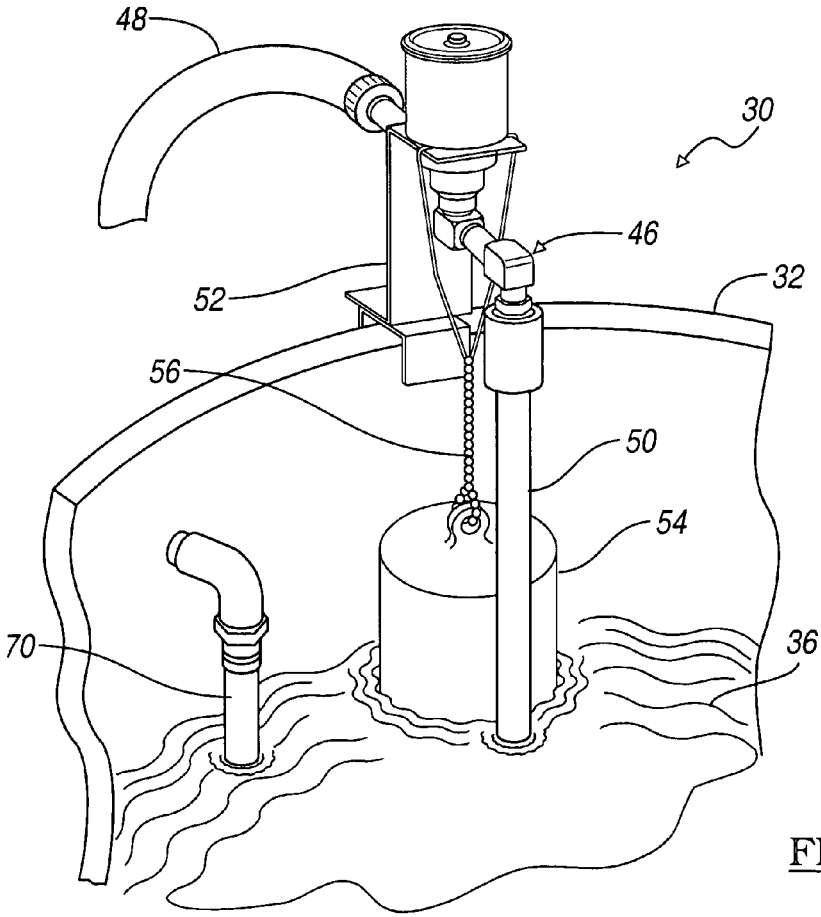
FIG. 6 is perspective view of the mixing apparatus control and feed system in accordance with the present invention.

Referring back to FIGS. 3 and 4, conduits 50 cooperate with supply device 46 to receive and dispense an aqueous solution in container 32. Conduits 50 include a supply pipe 58 and one or more injection pipes 60. In one aspect of the present invention, the supply pipe 58 extends generally vertically through the container 32 between the supply device 46 mounted to a first end and terminating at one or more horizontally extending pipes 60 at a second end. Further, as shown in FIG. 4, the injection pipes 60 may form a generally U-shaped pipe.

In one aspect of the present invention, conduit 50 includes one or more upper injection inlets 62 extending generally parallel to the supply pipe 58. Injection inlet 62 may include a nozzle 64, which may be directed generally downward, that creates an increased pressure flow for forcing the aqueous solution downward through the cleaning solution 36 toward the additive 34 to turbulate the additive to start the mixing process. It is understood that the discharge portion of the injection inlet 62 may be narrowed to create an increased pressure flow. Injection inlet 62 may be disposed within a central interior portion of container 32 as shown in FIG. 3, or alternatively, disposed adjacent an upper portion of the container, as shown in FIG. 4.

The one or more horizontally extending pipes 60 are disposed adjacent a lower surface of the container 32. Pipes 60 are configured to allow the additive 34 to be placed on top of the pipes 60 when loaded in container. Pipes 60 may include one or more nozzles 66 or a plurality of holes 68 in the pipes 60 that allow an aqueous solution to be discharged or forced therethrough to turbulate the additive 34. The turbulation from the one or more horizontal pipes 60 assist in the mixing process and ensure that the additive 34 is fully mixed in container 32 such that the additive does not cake and harden within container.

An outlet distribution system 70 is configured to remove cleaning solution 36 from the container 32 for the vehicle washing system. Outlet 70 includes an opening or valve 72 in a supply line or conduit 74 disposed below the upper level of the cleaning solution 36. A distribution or suction device 76 is coupled to supply line 74 to withdraw the cleaning solution 36 through the opening 72. It is understood that opening may include a nozzle portion to assist in directing the flow of cleaning solution into supply line 74. Distribution device 76 may include a pump or other solution removal mechanism and allows cleaning solution 36 to flow through distribution line 78 when drawn upon by the vehicle washing system.

A process for mixing a cleaning solution using the mixing apparatus of the present invention for a vehicle washing system is described in greater detail. Additive 34, as described above, can include any variety of chemical compositions in any form. For exemplary purposes, additive 34 will be described as a dry granular detergent solution that is poured into container 32. The amount of additive poured into the container typically will depend on the size of the container 32 being used to maximize the potential for obtaining equilibrium in the cleaning solution formed by mixing the additive and aqueous solution.

An aqueous solution, for purposes of this explanation, water, is added to the container 32. It is understood that water may be added using a variety of methods, including a direct feed from an external supply line. In the aspect described herein, water is added to container 32 by conduits 50 through the injection inlet 62. It is also contemplated that aqueous solution may be forced outward through the one or more horizontally extending pipes 60 disposed adjacent the base of the container 32.

Dry granular detergent additive 34 is poured into container 32 as the water level in container 32 rises above injection inlet 62. It is understood that the dry granular detergent may be added at any time, including prior to the addition of water to the container. However, to optimize the mixing process, it may be preferred to add the granular detergent to the container after a discrete amount of water is poured therein. The amounts of detergent to be added may also be controlled by use of the indicators 44 on the container 32.

Water will continue to be added to the container until the level is high enough to cause the float 54 to release its pull upon the chain 56, thereby causing the supply device 46 to shut off the flow of water. At this point the system will establish equilibrium and undissolved detergent will fall to the bottom of the container. Water entering the container 32 mixes with saturated cleaning solution 36 already in the container 32 and dilutes the detergent additive 34 until the point of saturation or equilibrium is reached.

As cleaning solution 36 is drawn from the container 32 through the outlet 70 by the distribution device 76, the level of the cleaning solution 36 will decrease to the point where the float 54 will begin to pull on the chain 56 attached to the supply device 46. Once activated, the supply device 46 will allow water to flow through conduits toward injection inlet 62 and horizontal pipes 60. Water will continue to flow until the level is high enough to cause the float 54 to release its pull on the supply device 46, which thereby shuts off the flow of water. As water is added, the agitation caused by the addition of the water through injection inlet 62 and horizontal pipes 60 causes the undissolved detergent 34 to mix with the water to reach an equilibrium point, thereby creating the cleaning solution 36.

When the cleaning solution formed by the interaction between the water and dry granular detergent is exhausted, the filling and mixing procedure is repeated in its entirety. The ability to continue to use the system while replenishing the detergent and to have a substantial reserve of undissolved detergent at the bottom of the tank allows the user uninterrupted use of the system and the ability to leave the system unattended for several days at a time.

In another aspect of the present invention, the "drain/fill" cycle will continue to repeat as the cleaning solution 36 is drawn from the container. As solution is drawn from the container, water is added and additional detergent dissolved, the level of undissolved detergent will be reduced and will fall below a lower or "Add" indicator 44 on container 32. At this time, detergent additive 34 is added by the customer in sufficient quantity to reach the upper or "Full" indicator 44 on container 32. This process can continue for an unrestricted period of time, keeping the system constantly available for use. Indicators assist a customer to ensure there is always a sufficient volume of detergent additive, and thereby solution in the container 32 such that the measured proportion of detergent additive dissolved in the water always remains at, or near, saturated levels.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. An apparatus configured for mixing and distributing a cleaning solution for use in a vehicle washing system, the mixing apparatus comprising:

a generally translucent container defining a cavity therein, the container including one or more indicators marked on the outer surface and adjacent a lower surface of the container, the container adapted to receive an additive at least level with the one or more indicators;

a supply device disposed adjacent an upper surface of the container for providing an aqueous solution to the cavity of the container;

an upper injection inlet in fluid communication with the supply device, the upper injection inlet having a nozzle directed generally downward;

a lower injection inlet in fluid communication with the upper injection inlet, the lower injection inlet further including a generally U-shaped pipe extending adjacent the lower surface of the container;

a supply pipe operatively connecting the supply device and further connecting upper and lower injection inlets, the upper and lower injection inlets configured for supplying the aqueous solution under pressure in order to turbulate the additive;

a distribution device in communication with the cavity of the container configured to remove the aqueous solution from the container for distribution to the vehicle washing system; and a control mechanism releasably connected to the supply device for monitoring the level of aqueous solution in the container, wherein the aqueous solution mixes with an additive to create the cleaning solution, and the one or more indicators cooperate with the translucent container to allow an additive to be placed in the container to a specified level such that when the aqueous solution is provided, an amount of undissolved additive remains in the bottom of the container in an amount at least level with the one or more indicators wherein when the level of the cleaning solution falls below a specified level, the control mechanism activates the supply device thereby injecting aqueous solution into the container at the upper and lower injection inlets in order to turbulate the additive.

2. The mixing apparatus of claim 1 wherein the control mechanism further comprises a float releasably connected to the supply device that moves with the level of aqueous solution in the container and activates the supply device if the level of the cleaning solution decreases below a predetermined height.

3. The mixing apparatus of claim 1 wherein the upper injection nozzle is disposed at a level in the container such that the upper injection nozzle is disposed below surface of the cleaning solution.

4. An apparatus configured for mixing and distributing a cleaning solution for distribution through one or more nozzles in a vehicle washing system, the mixing apparatus comprising:

a generally translucent container having a cavity defined therein configured to receive an additive;

a supply device for providing an aqueous solution to the cavity of the container;

one or more conduits including one or more injection inlets operatively connected to the supply device for supplying the aqueous solution where at least one injection inlet is directly connected to the supply device via the one or more conduits, the at least one injection inlet including an upper injection inlet operatively connected by the one or more conduits with at least one additional injection inlet disposed adjacent a lower surface of the container and having at least one pipe extending adjacent the lower surface of the container the pipe having openings configured for supplying the aqueous solution under pressure in order to turbulate the additive;

a distribution device in communication with the cavity of the container configured to remove the aqueous solution from the container for distribution to the vehicle washing system; and a control mechanism releasably connected to the supply device for monitoring the level of aqueous solution in the container, wherein the lower injection inlet supplies aqueous solution under pressure which mixes with an additive disposed in the container to create the cleaning solution such that when the aqueous solution is provided at a predetermined height, undissolved additive remains in the bottom of the container, and when the level of the cleaning solution falls below a specified level, the control mechanism activates the supply device thereby injecting aqueous solution into the container at the injection inlet in order to turbulate the additive.

5. The mixing apparatus of claim 4 wherein the translucent container includes one or more indicators that cooperate with the translucent container to allow an additive to be placed in the container to a specified level to mix with the aqueous solution to create the cleaning solution wherein the undissolved additive remains in the bottom of the container in an amount at least level with the one or more indicators.

6. The mixing apparatus of claim 4 wherein the at least one injection inlet further comprises a pair of pipes extending generally horizontally adjacent the lower surface of the cavity of the container configured to supply the aqueous solution under pressure.

7. The mixing apparatus of claim 4 wherein the at least one injection inlet further comprises a generally U-shaped pipe extending generally horizontally adjacent a lower surface of the cavity of the container.

8. The mixing apparatus of claim 4 wherein the upper injection inlet further includes a nozzle generally directed toward downward for supplying the aqueous solution under pressure.

9. An apparatus configured for mixing and distributing a cleaning solution for distribution through one or more nozzles in a vehicle washing system, the mixing apparatus comprising:

a generally translucent container defining a cavity therein configured to receive an additive, the container including at least one indicator marked on the outer surface and adjacent a lower surface of the container;

a supply device for providing an aqueous solution to the cavity of the container;

one or more conduits in communication with the supply device for supplying the aqueous solution under pressure in order to turbulate the additive, the one or more conduits including at least one upper injection inlet directly connected with at least one lower injection inlet via the one or more conduits;

a control mechanism releasably connected to the supply device for monitoring the level of cleaning solution in the container, the control mechanism configured to activates the supply device to maintain a minimum level of cleaning solution; and a distribution device disposed adjacent an upper surface of the container and configured to remove the cleaning solution from the container for distribution to the vehicle washing system, the distribution device including an outlet conduit in communication with the cavity of the container, wherein the upper and lower injection inlets supply aqueous solution under pressure in order dilute an additive which is placed in the container to create the cleaning solution such that when the aqueous solution is provided at a predetermined height, undissolved additive remains in the bottom of the container, and when the level of the cleaning solution falls below a specified level, the control mechanism activates the supply device thereby injecting additional aqueous solution into the container at the injection inlet in order to turbulate the additive to create additional cleaning solution.

10. The mixing apparatus of claim 9 where the lower injection inlet is disposed adjacent a lower surface of the container.

11. The mixing apparatus of claim 9 wherein the lower injection inlet further comprises a pair of pipes extending generally horizontally adjacent a lower surface of the cavity of the container the pipes having a plurality of openings configured to supply the aqueous solution under pressure.

12. The mixing apparatus of claim 9 wherein the lower injection inlet further comprises a generally U-shaped pipe extending generally horizontally adjacent a lower surface of the cavity of the container.

13. The mixing apparatus of claim 9 wherein the upper injection inlet further comprises openings configured to direct the aqueous solution towards the lower surface of the cavity of the container.

14. The mixing apparatus of claim 9 wherein at least one of the upper and lower injection inlets further includes a nozzle generally directed toward downward for supplying the aqueous solution under pressure.

15. The mixing apparatus of claim 9 wherein the control mechanism further comprises a float releasably connected to the supply device that moves with the level of aqueous solution in the container and activates the supply device if the level of the cleaning solution decreases below a predetermined height.

16. The mixing apparatus of claim 9 wherein the one or more conduits is a supply pipe operatively connected to the supply device.

17. The mixing apparatus of claim 16 wherein the supply pipe is operatively connected to the upper and lower injection inlets thereby directly connecting the upper and lower injection inlets to the supply device.

* * * * *

UNITED STATES PATENT AND TRADEMARK OFFICE

CERTIFICATE OF CORRECTION

PATENT NO. : 7,862,225 B2
APPLICATION NO. : 11/492550
DATED : January 4, 2011
INVENTOR(S) : Thomas C. Betchan It is certified that error appears in the above-identified patent and that said Letters Patent is hereby corrected as shown below:

Column 8, Line 56-57, Claim 9:

Delete “activates” and insert -- activate --.

Signed and Sealed this
First Day of March, 2011

David J. Kappos

David J. Kappos
*Director of the United States Patent and Trademark Office*